US008033864B1

(12) United States Patent
Cho

(10) Patent No.: US 8,033,864 B1
(45) Date of Patent: Oct. 11, 2011

(54) ELECTRICAL PLUG WITH A SLIDING COVER EXTENDING FROM A FRONT OF AN INTERNAL CONTACT HOLDER

(75) Inventor: I-Chiung Cho, Bade (TW)

(73) Assignee: Kuo Chie Precision Industrial Co., Ltd., Bade, Taoyuan County (TW)

( * ) Notice: Subject to any disclaimer, the term of this patent is extended or adjusted under 35 U.S.C. 154(b) by 0 days.

(21) Appl. No.: 12/876,165

(22) Filed: Sep. 6, 2010

(51) Int. Cl.
*H01R 13/68* (2011.01)

(52) U.S. Cl. ..... 439/620.26

(58) Field of Classification Search ..... None
See application file for complete search history.

(56) References Cited

U.S. PATENT DOCUMENTS

| | | | | |
|---|---|---|---|---|
| 4,834,664 | A * | 5/1989 | Lin | 439/145 |
| 5,637,017 | A * | 6/1997 | Hsu | 439/620.29 |
| 6,132,257 | A * | 10/2000 | Wang et al. | 439/620.34 |
| 6,326,878 | B1 * | 12/2001 | Liang | 337/215 |
| 7,021,968 | B1 * | 4/2006 | Lu | 439/620.07 |
| 7,137,837 | B2 * | 11/2006 | Chen et al. | 439/247 |
| 7,803,019 | B2 * | 9/2010 | Yen | 439/620.01 |

* cited by examiner

*Primary Examiner* — Chandrika Prasad

(57) ABSTRACT

An electrical plug includes an internal contact holder, which comprises a holder base, a top cover covering the holder base and a sliding cover slidably coupled to two sliding grooves in an opening in the top cover and movable along the sliding grooves in and out of the top cover to close/open the opening, a first metal conducting member installed in the holder base and extending out of the front and rear sides of the holder base and a second and third metal conducting members installed in the holder base and respectively extended out of the front and rear sides of the holder base, and a fuse electrically connected between the second and third metal conducting members and suspending in the opening of the top cover.

7 Claims, 11 Drawing Sheets

ELECTRICAL PLUG WITH A SLIDING COVER EXTENDING FROM A FRONT OF AN INTERNAL CONTACT HOLDER

BACKGROUND OF THE INVENTION

1. Field of the Invention

The present invention relates to electrical plugs and more particularly, to an electric plug with a fuse therein, which keeps the fuse from sight and prohibits replacement of the fuse when the electrical plug is connected to an electrical outlet.

2. Description of the Related Art

Many electrical plugs are known having a fuse for current-limiting protection. However, these electrical plugs are still not satisfactory in function due to the following drawbacks:

1. No safety measure is provided: A cover is provided to protect the fuse and to keep the fuse from sight. If the fuse is burned out, the user can open the cover to replace the burnt fuse. However, there is no safety means to prohibit the cover from being opened when the electrical plug is connected to an electrical outlet. When replacing the fuse as the electrical plug is kept connected to the electrical outlet, an accidental electric shock may occur. Further, a child may open the cover and touch the internal circuit to cause an electric shock accidentally.

2. Component parts may be loosened easily: The component parts of conventional fuse-protected electrical plugs are assembled by means of electrically connecting the power cable to the metal conducting members and then installing the metal conducting members in an electrically insulative housing. When stretching the power cable, the metal conducting members may be biased, or the connection between the power cable and the metal conducting members may be loosened, resulting in an accidental shock circuit or occurrence of sparks or fire accident.

SUMMARY OF THE INVENTION

The present invention has been accomplished under the circumstances in view. It is the main object of the present invention to provide an electrical plug carrying a fuse, which prohibits replacement of the fuse when the electrical plug is connected to an electrical outlet, keeping the fuse out of children's reach and avoiding accidental electric shock.

It is another object of the present invention to provide an electrical plug carrying a fuse, which prohibits entering of outside water to wet the internal metal conducting member set, avoiding short circuit or contact failure.

To achieve these and other objects of the present invention, an electrical plug comprises an internal contact holder, which comprises a holder base, a top cover covering the holder base and a sliding cover slidably coupled to two sliding grooves in an opening in the top cover and movable along the sliding grooves in and out of the top cover to close/open the opening, a metal conducting member set, which comprises a first metal conducting member installed in the holder base and extending out of the front and rear sides of the holder base and a second and third metal conducting members installed in the holder base and respectively extended out of the front and rear sides of the holder base, and a fuse electrically connected between the second and third metal conducting members and suspending in the opening of the top cover.

DETAILED DESCRIPTION OF THE PREFERRED EMBODIMENT

Figure 1:
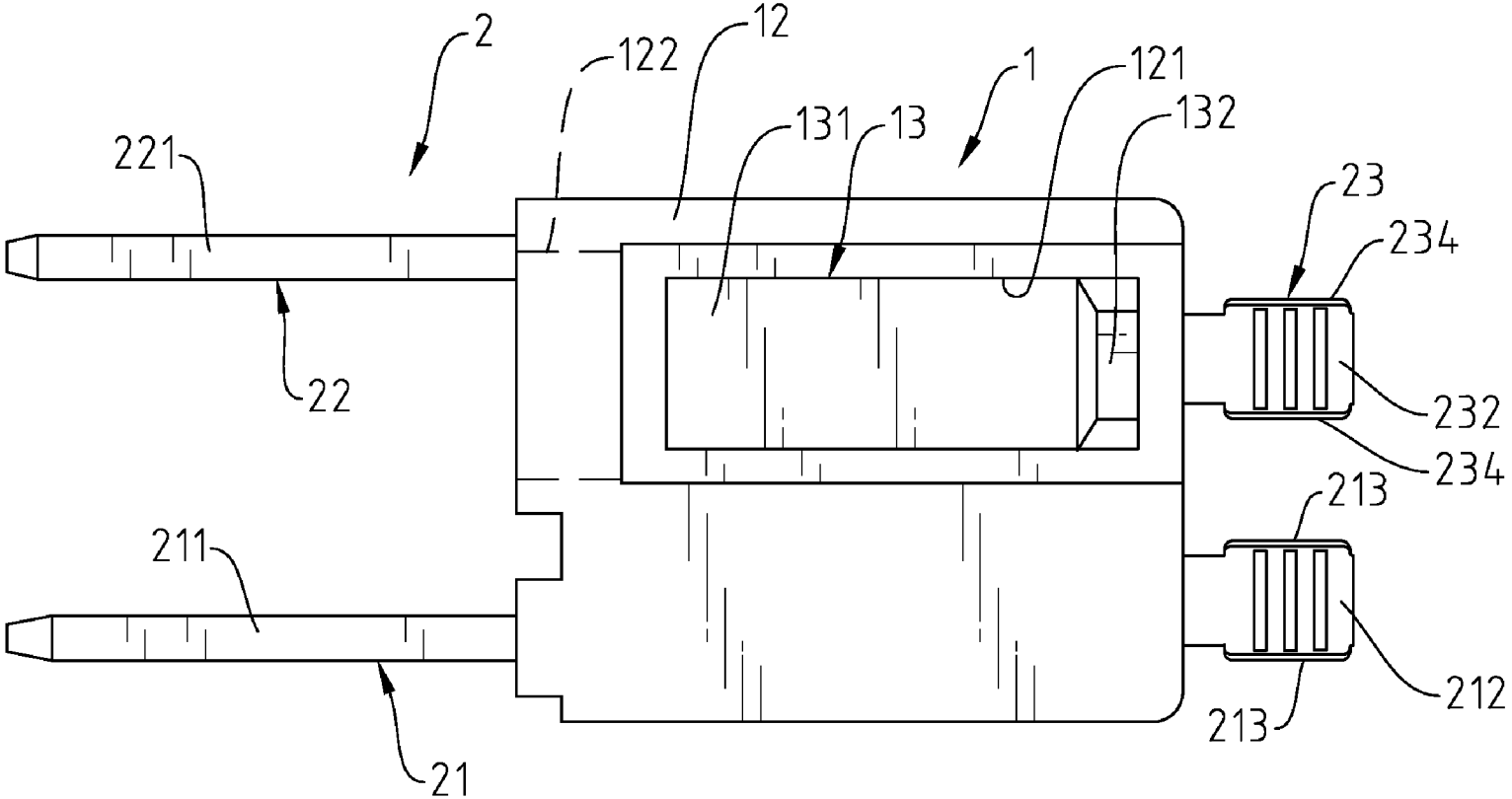
FIG. 1 is a top plain view of an electrical connector in accordance with a first embodiment of the present invention, showing the internal contact holder and the metal conducting member assembled and the sliding cover closed.
Figure 2:
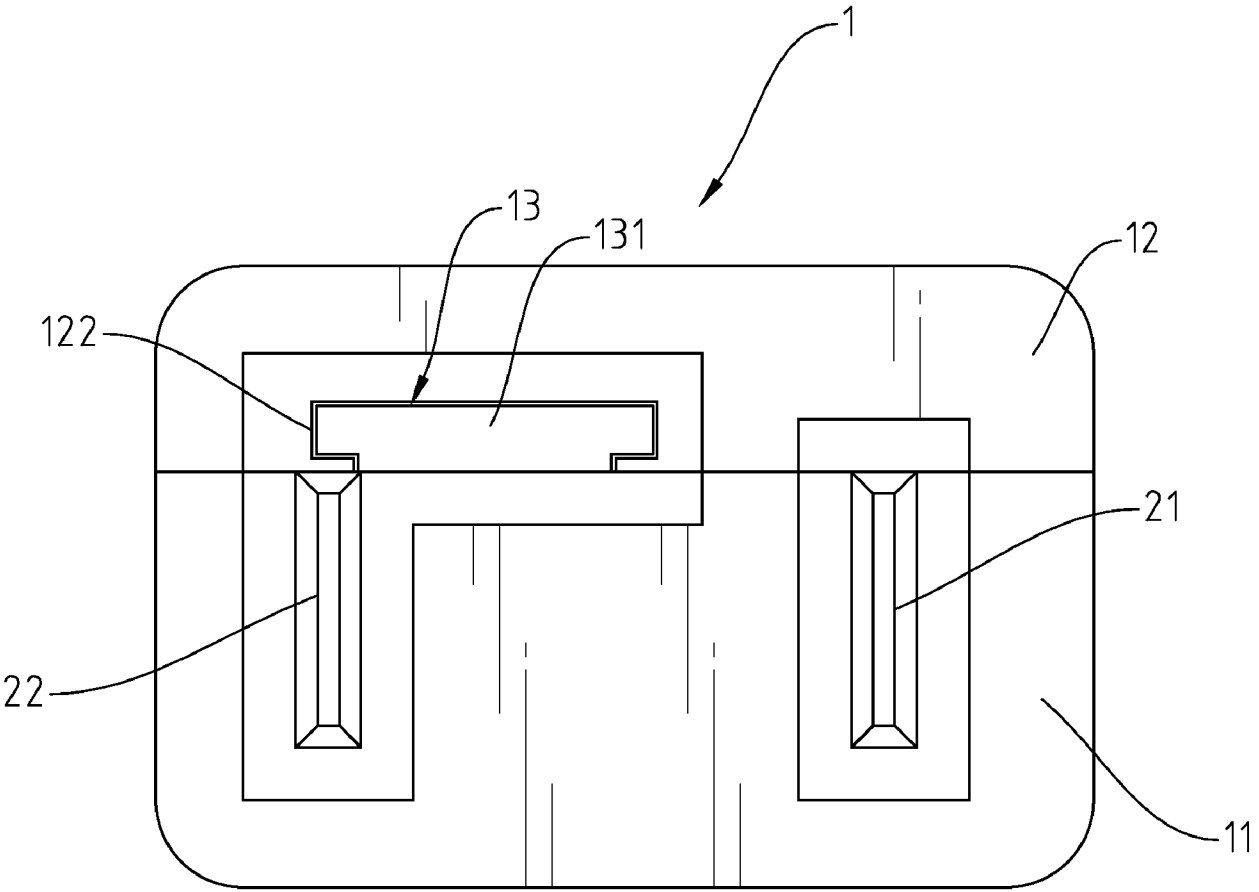
FIG. 2 is a front view, in an enlarged scale, of the assembly shown in FIG. 1.
Figure 3:
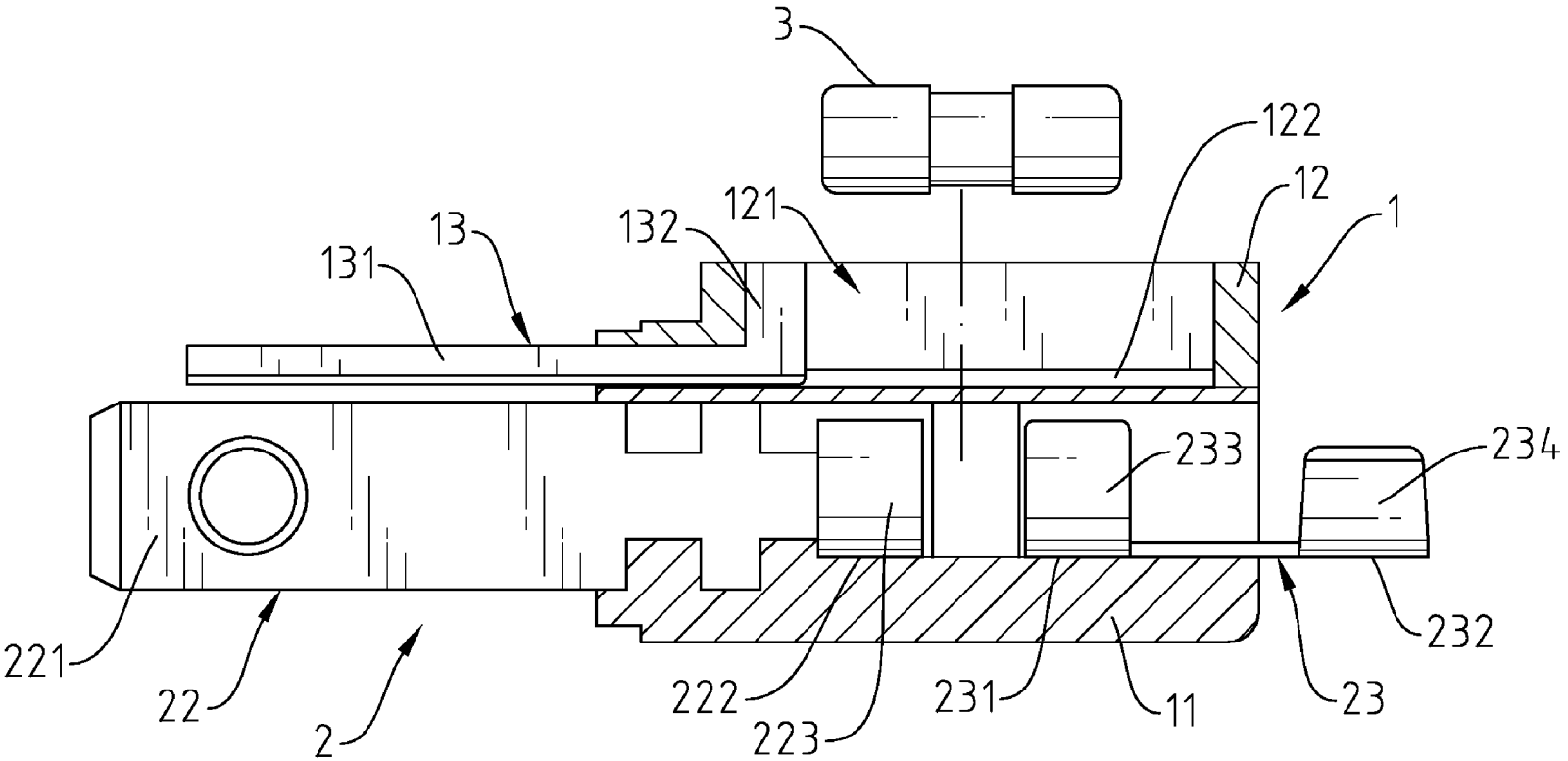
FIG. 3 is a schematic sectional side view of the assembly shown in FIG. 1, illustrating the sliding cover opened for the installation of a fuse.

Referring to FIGS. 1-3, an electrical plug in accordance with a first embodiment of the present invention comprises an internal contact holder 1 and a metal conducting member set 2.

The internal contact holder 1 comprises a holder base 11, a top cover 12 covered on the holder base 11 and fixedly secured thereto by ultrasonic fusion, and a sliding cover 13 slidably mounted in the top cover 12. The top cover 12 has an opening 121 defined therein, and two sliding grooves 122 respectively located on two opposing inside walls thereof in the opening 121 and extending to the front side thereof. The sliding cover 13 comprises a cover body 131 coupled to the sliding grooves 122 and kept in close contact with the surface of the top cover 12 and movable along the sliding grooves 122 in and out of the top cover 12 to close or open the opening 121, and handle 132 perpendicularly upwardly extended from one end of the cover body 131 and suspending in the opening 121 to prohibit falling of the sliding cover 13 out of the top cover 12.

The metal conducting member set 2 comprises a first metal conducting member 21, a second metal conducting member 22 and a third metal conducting member 23. The first metal conducting member 21 is fixedly fastened to the holder base 11 of the internal contact holder 1 near one lateral side. The second metal conducting member 22 and the third metal conducting member 23 are respectively fixedly fasted to the front and rear sides of the holder base 11 of the internal contact holder 1 near the other lateral side and arranged in a parallel manner relative to the first conducting metal member 21. The first metal conducting member 21 has its one end extending out of the front side of the holder base 11 of the internal contact holder 1 and terminating in a first blade 211, and its other end extending out of the rear side of the holder base 11 of the internal contact holder 1 and terminating in a first wire connector 212. The second metal conducting member 22 has its one end terminating in a first conducting portion 222 and fixedly fastened to the inside of the holder base 11 of the internal contact holder 1, and its other end extending out of the front side of the holder base 11 of the internal contact holder 1 and terminating in a second blade 221. The third metal conducting member 23 has its one end terminating in a second conducting portion 231 and fixedly fastened to the inside of the holder base 11 of the internal contact holder 1, and its other end extending out of the rear side of the holder base 11 of the internal contact holder 1 and terminating in a second wire connector 232. The second metal conducting member 22 further comprises two first retaining flanges 223 respectively upwardly extended from two opposite lateral sides of the first conducting portion 222. The third metal conducting member 23 further comprises two second retaining flanges 233 respectively upwardly extended from two opposite lateral sides of the second conducting portion 231. The first wire connector 212 comprises two first mounting flanges 213 respectively upwardly extended from two opposite lateral sides thereof. The second wire connector 232 comprises two second mounting flanges 234 respectively upwardly extended from two opposite lateral sides thereof.

Figure 4:
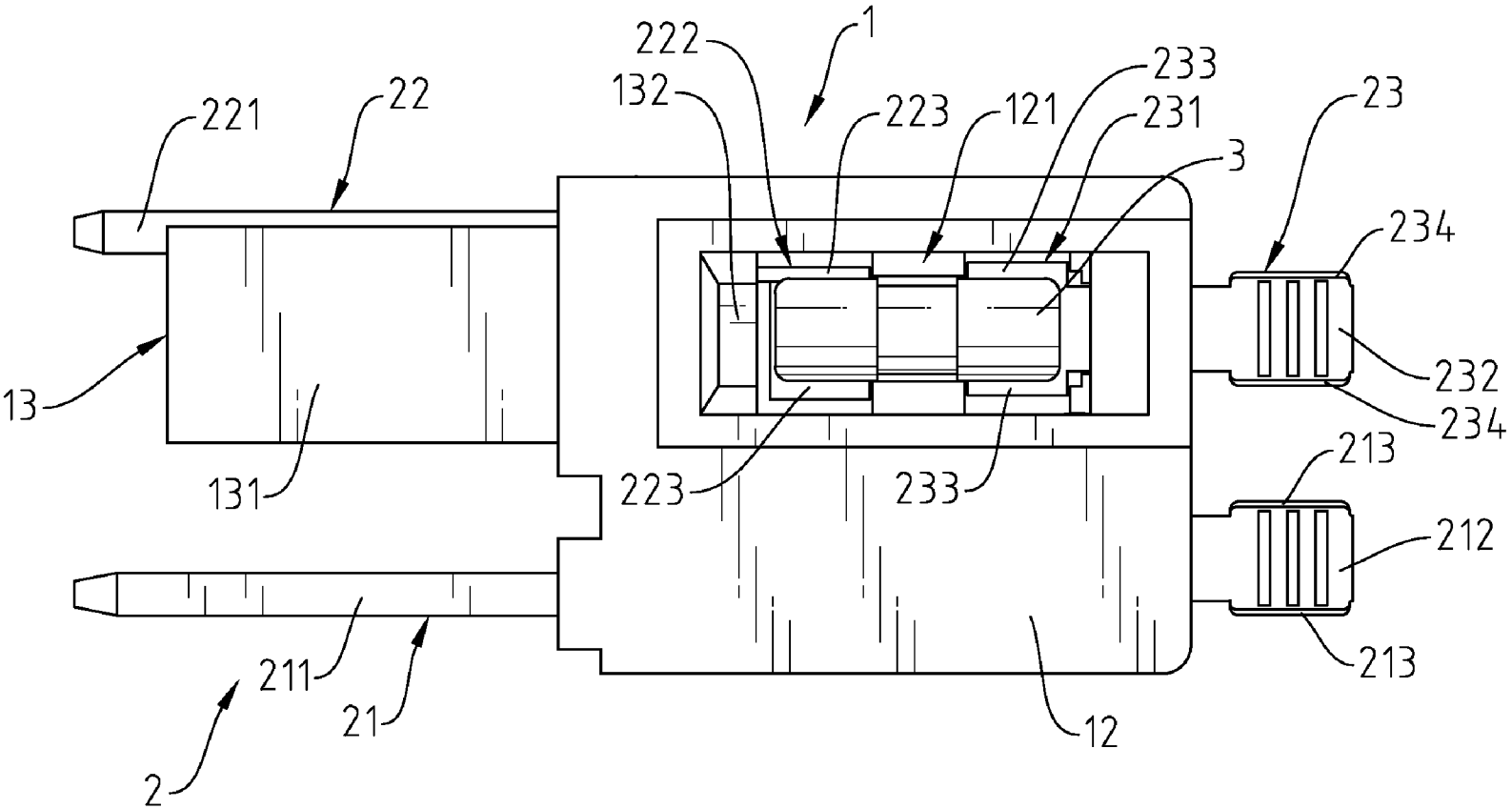
FIG. 4 is a top view of the assembly shown in FIG. 3.
Figure 5:
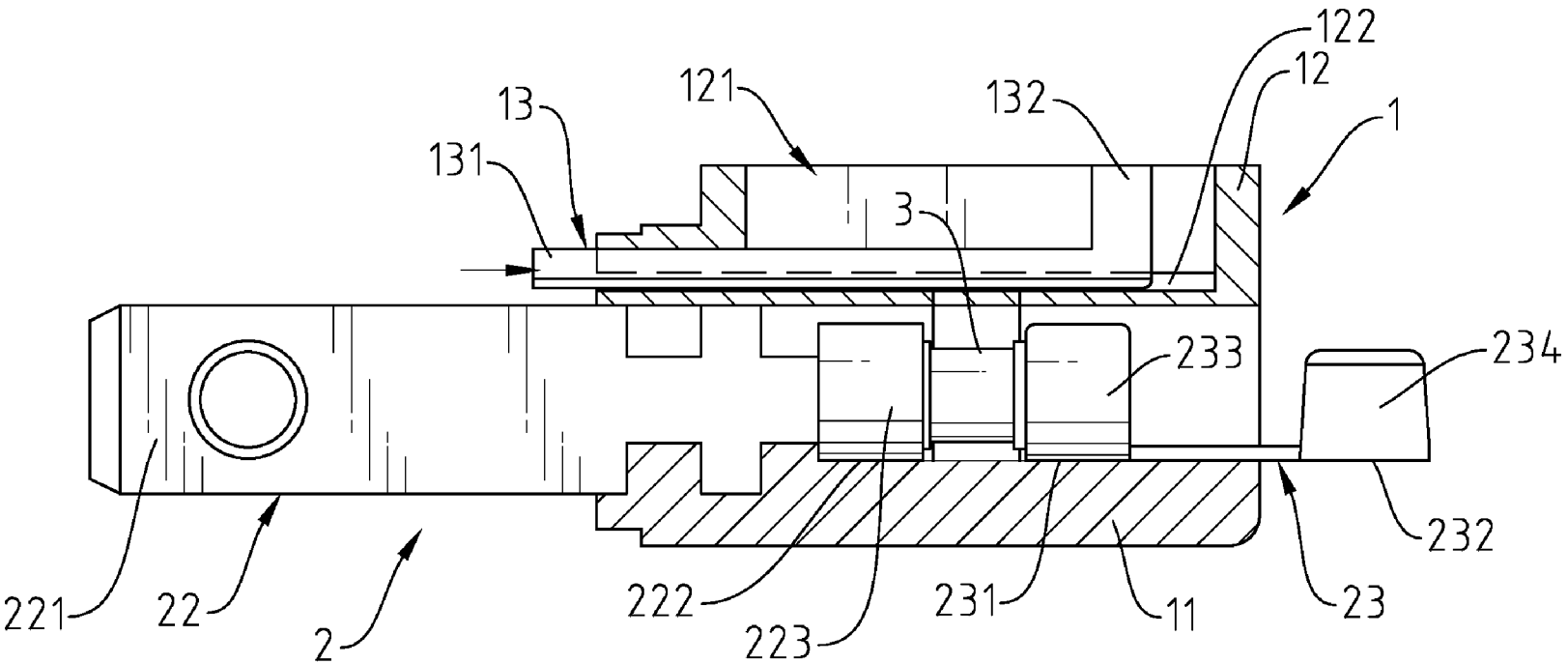
FIG. 5 is a schematic sectional side view of the assembly shown in FIG. 1, illustrating the sliding cover moved into the inside of the opening.

Referring to FIGS. 4 and 5 and FIG. 3 again, a fuse 3 is electrically connected between the second metal conducting member 22 and the third metal conducting member 23. During installation of the fuse 3, operate the handle 132 to move the cover body 131 of the sliding cover 13 along the sliding grooves 122 toward the outside of the top cover 12 to open the opening 121, and then insert the fuse 3 into the opening 121 to have the two opposite ends of the fuse 3 to be respectively fastened to the first retaining flanges 223 and the second retaining flanges 233. Thus, the second metal conducting member 22 and the third metal conducting member 23 are electrically connected together by the fuse 3. Thereafter, operate the handle 132 to move the cover body 131 of the sliding cover 13 along the sliding grooves 122 toward the inside of the top cover 12 to close the opening 121.

Figure 6:
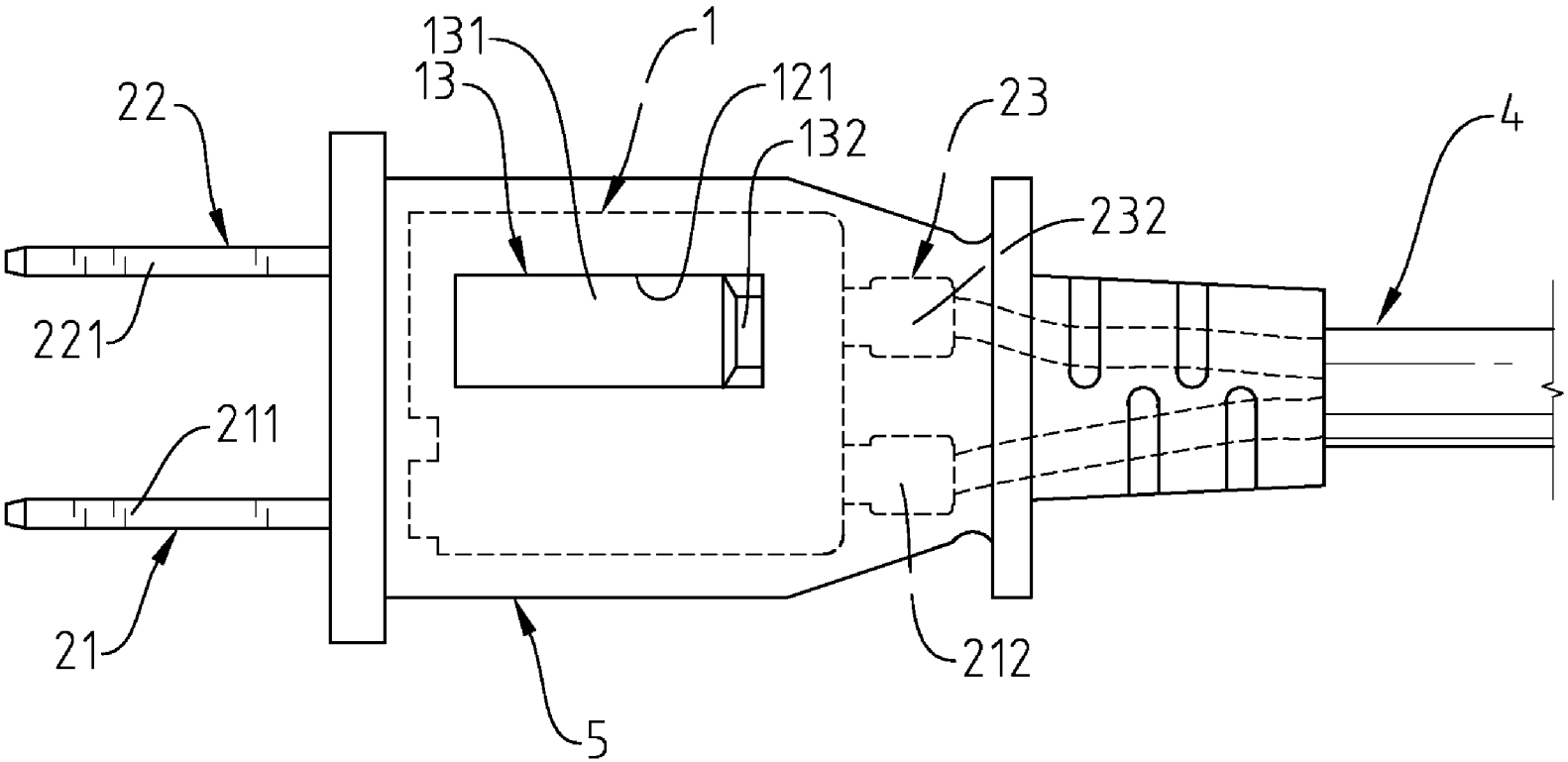
FIG. 6 is a schematic top plain view of an electrical plug embodying the present invention.
Figure 7:
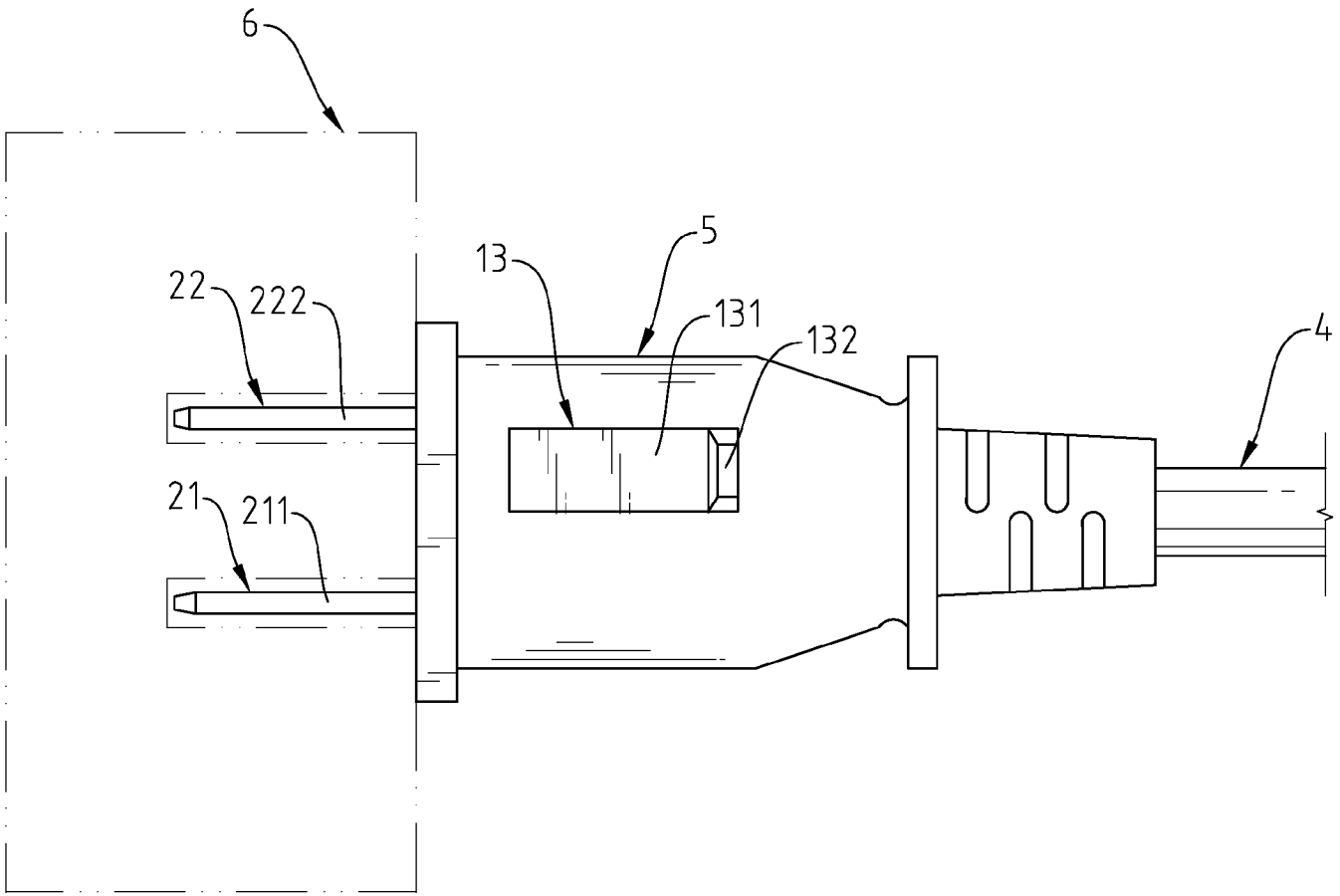
FIG. 7 is a schematic top view of the present invention, illustrating the electrical plug inserted into an electrical outlet.
Figure 8:
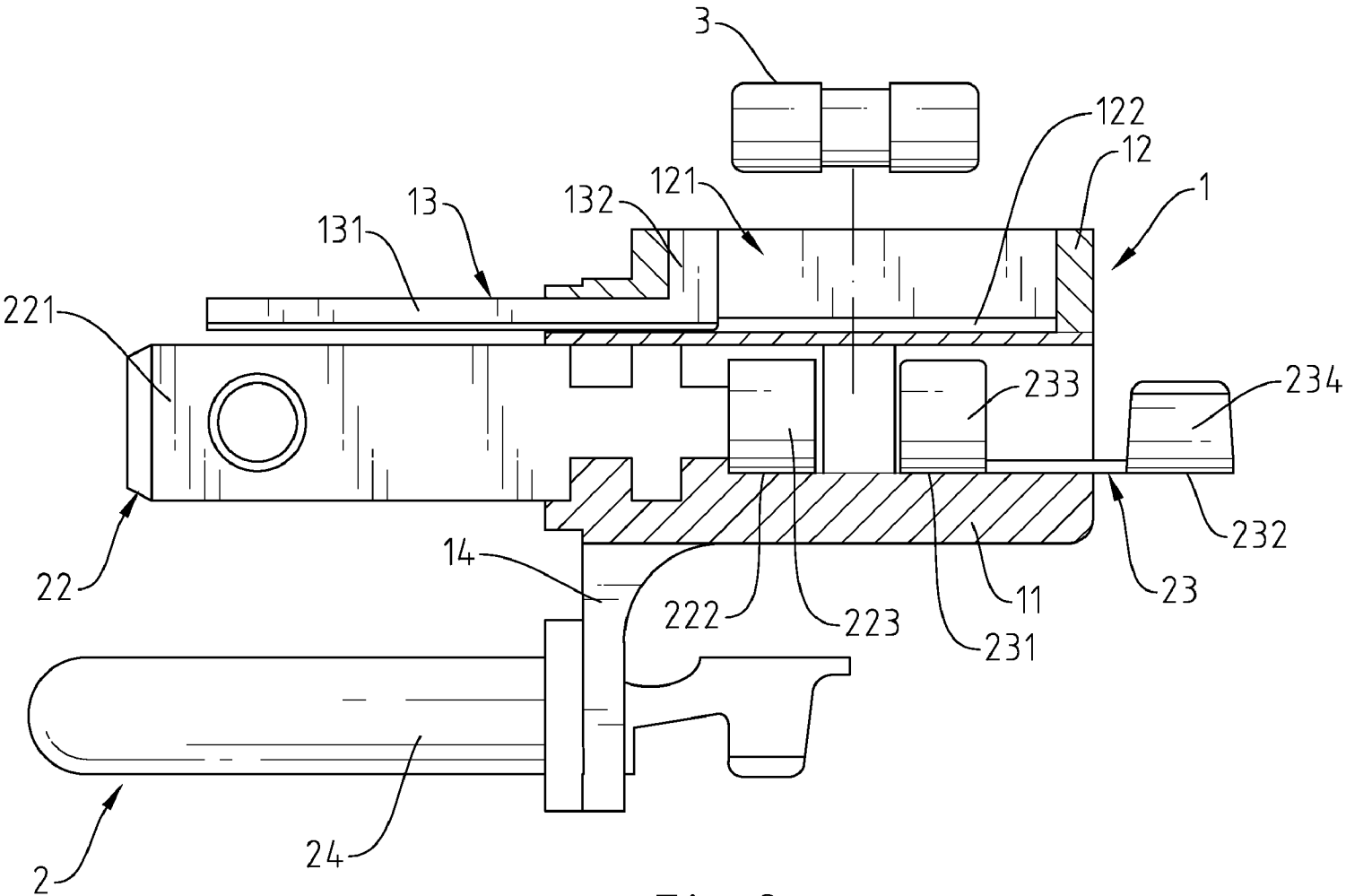
FIG. 8 is a sectional side view of a part of an electrical plug in accordance with a second embodiment of the present invention.
Figure 9:
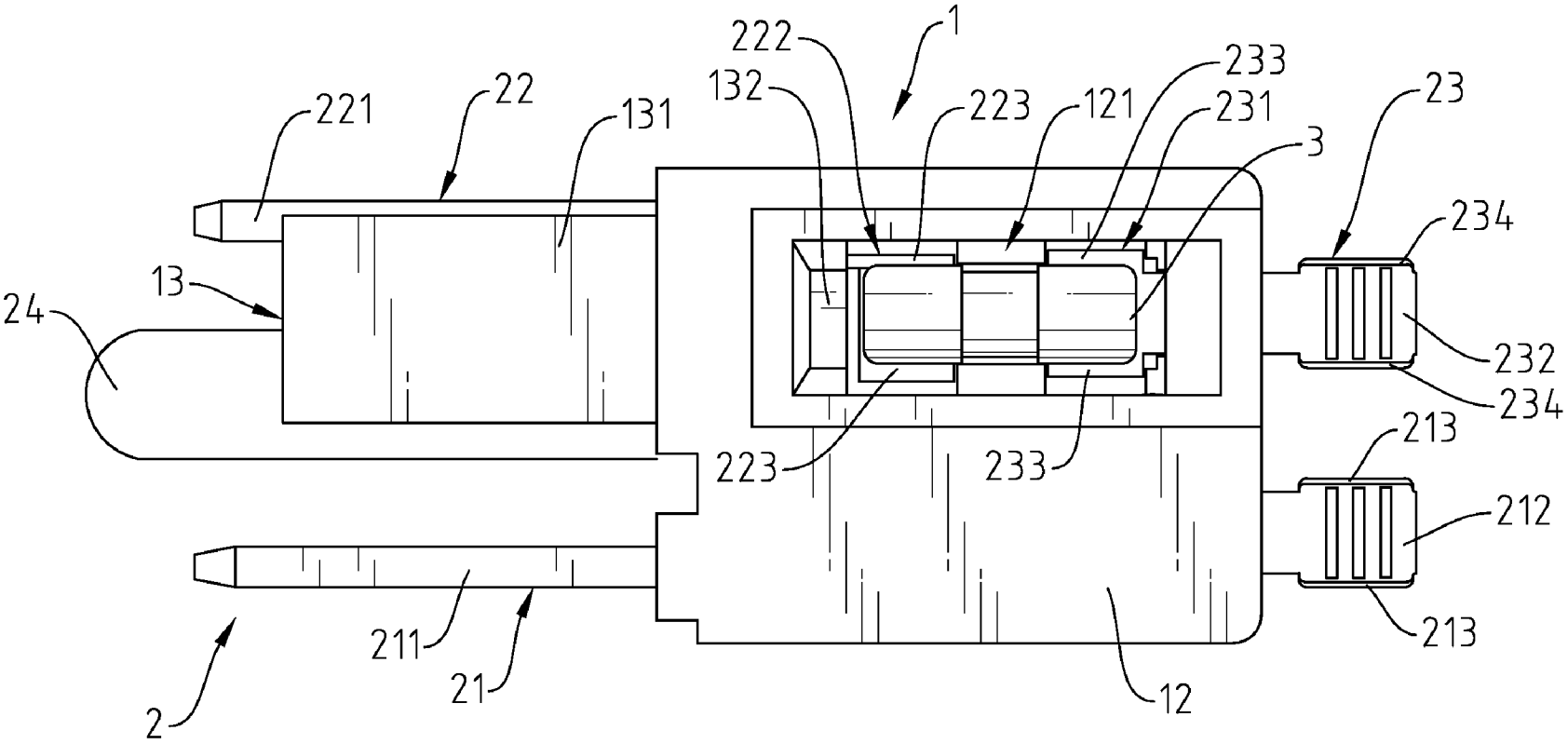
FIG. 9 is a schematic top view of the assembly shown in FIG. 8.
Figure 10:
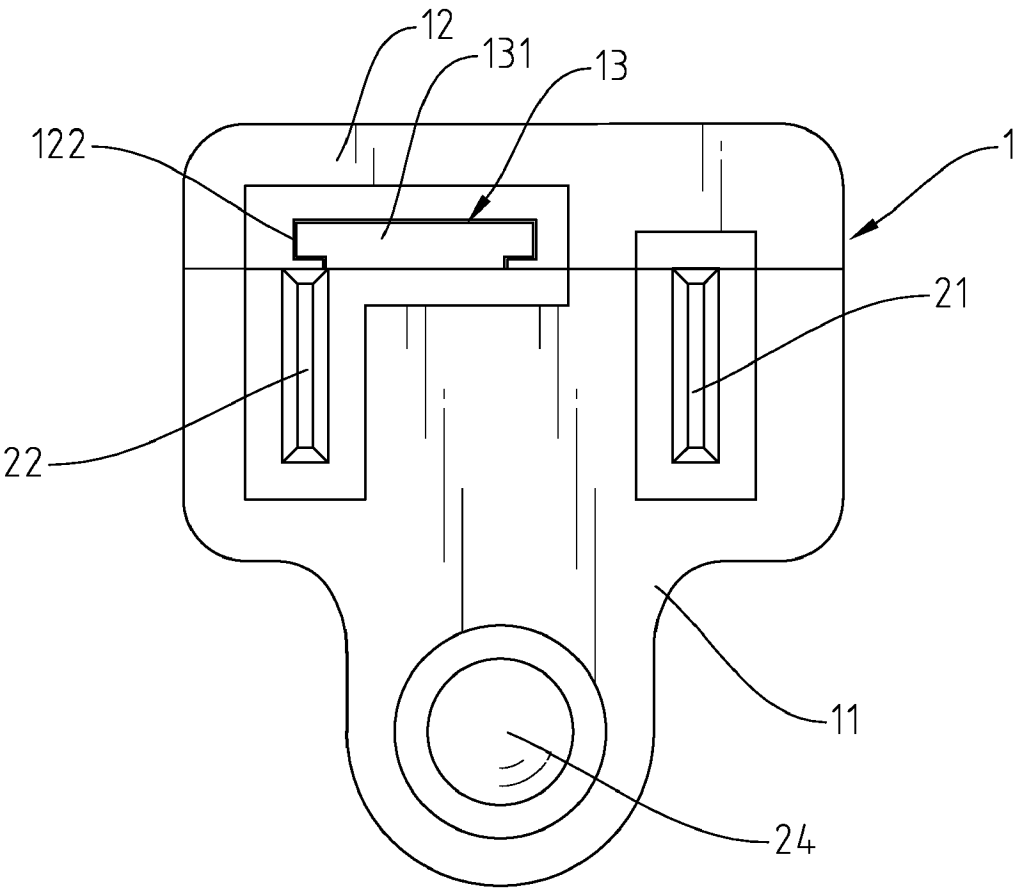
FIG. 10 is a front view in an enlarged scale of the assembly shown in FIG. 8.
Figure 11:
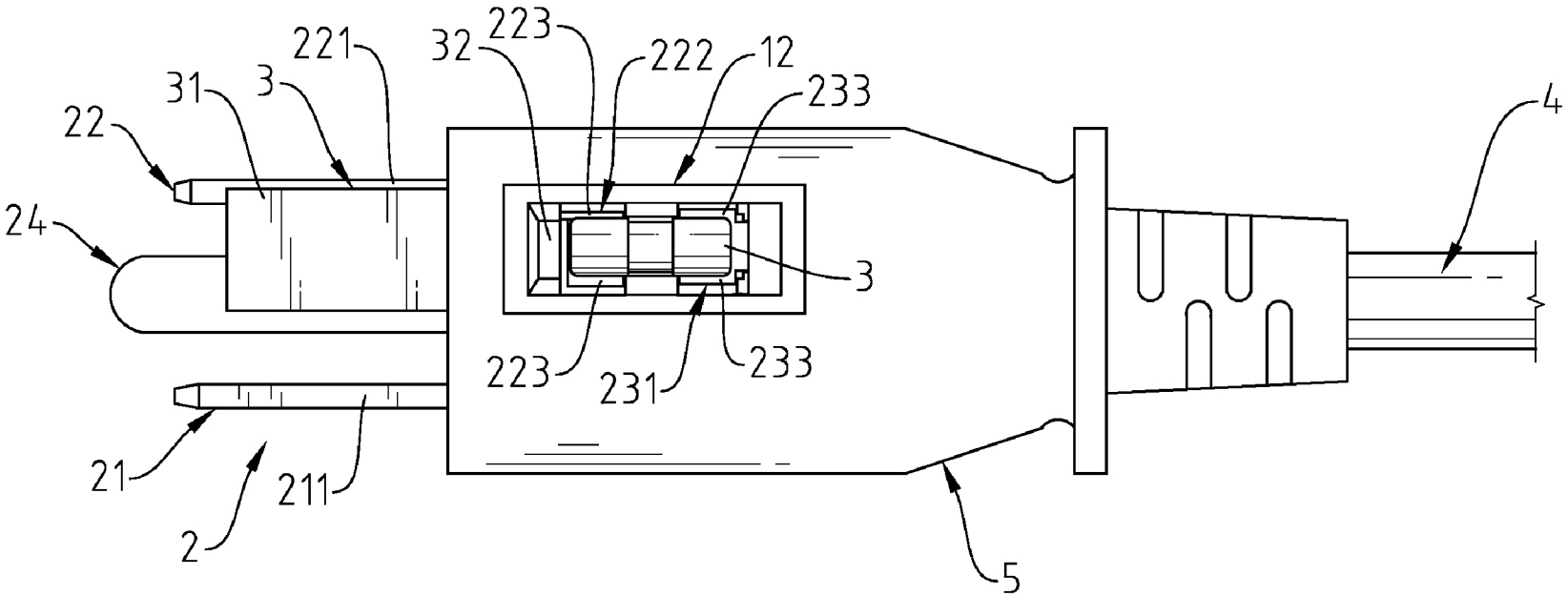
FIG. 11 is a top view of the electrical plug in accordance with the second embodiment of the present invention.

Referring to FIGS. 6 and 7 and FIG. 5 again, when using the assembly of the aforesaid internal contact holder 1 and metal conducting member set 2 to make an electrical plug, fixedly connect the positive and negative wires of the power cable 4 to the two first mounting flanges 213 of the first wire connector 212 and the two second mounting flanges 234 of the second wire connector 232 by riveting for electric power transmission, and then mold an electrically insulative housing 5 on the outside of the assembly of the internal contact holder 1 and metal conducting member set 2 by insert molding to let the opening 121, the first blade 211, the second blade 221 and the sliding grooves 122 to be exposed to the outside of the electrically insulative housing 5. When inserted the first blade 211 and the second blade 221 into an electrical outlet 6 during an application of the electrical plug, the front ends of the sliding grooves 122 are abutted against the front surface of the electrical outlet 6, and the handle 132 of the sliding cover 13 is not operable to move the cover body 131 out of the top cover 12, and therefore the fuse 3 is constantly kept from sight.

FIGS. 8-11 illustrate an electrical plug in accordance with a second embodiment of the present invention. According to this second embodiment, the holder base 11 of the internal contact holder 1 has an extension mount 14 extended from one side thereof remote from the top cover 12; the metal conducting member set 2 further comprises a fourth metal conducting member 24 fixedly mounted in the extension mount 14 of the holder base 11 and extended out of the electrically insulative housing 5 in the same direction relative to the first metal conducting member 21 and the second metal conducting member 22 and electrically connected with the ground wire (not shown) of the power cable 4 for grounding.

In conclusion, the invention has advantages over the conventional techniques subject to the technical features as follows:

1. When inserted the first blade 211 and second blade 221 of the electrical plug into an electrical outlet 6, the handle 132 of the sliding cover 13 is not operable to move the cover body 131 out of the top cover 12, and therefore the opening 121 is closed by the sliding cover 13 and the fuse 3 is constantly kept from sight. If the fuse 3 is burnt out, the user cannot open the sliding cover 13 for allowing replacement of the burnt fuse without separating the electrical plug from the electrical outlet 6, keeping the burnt fuse out of children's reach and avoiding accidental electric shock.

2. The cover body 131 of the sliding cover 13 is coupled to the sliding grooves 122 and kept in close contact with the surface of the top cover 12. When the sliding cover 13 is kept in the top cover 12, it closes the opening 121 in a watertight manner to prohibit entering of outside water into the inside of the holder base 11 of the internal contact holder 1 to wet the metal conducting member set 2, avoiding short circuit or contact failure.

3. The internal contact holder 1, the metal conducting member set 2 and the connection area between the metal conducting member set 2 and the power cable 4 are surrounded by the electrically insulative housing 5 and secured firmly in position by the electrically insulative housing 5. Therefore, stretching the power cable 4 does not cause disconnection between the power cable 4 and the metal conducting member set 2, avoiding the occurrence of an accidental short circuit or sparks.

Although particular embodiments of the invention have been described in detail for purposes of illustration, various modifications and enhancements may be made without departing from the spirit and scope of the invention.

What is claimed is:

1. An electrical plug, comprising:

an internal contact holder, said internal contact holder comprising a holder base, a top cover covered on said holder base, said top cover having an opening and a plurality of sliding grooves arranged in said opening on opposing sides of the opening and extending to a front of the internal contact holder, and a sliding cover slidably coupled to said sliding grooves of said top cover and movable along said sliding grooves of said top cover to close and open said opening, wherein when opened the sliding cover extends from the front of the internal contact holder;

a metal conducting member set mounted in said internal contact holder, said metal conducting member set comprising a first metal conducting member, a second metal conducting member and a third metal conducting member, said first metal conducting member being fixedly fastened to said holder base of said internal contact holder near one lateral side of said holder base, said second metal conducting member and said third metal conducting member being respectively fixedly fastened to front and rear sides of said holder base of said internal contact holder near an opposite lateral side of said holder base and arranged in a parallel manner relative to said first conducting metal member, said first metal conducting member having an end thereof extending out of the front side of said holder base and terminating in a first blade and an opposite end thereof extending out of the rear side of said holder base and terminating in a first wire connector, said second metal conducting member having an end thereof terminating in a first conducting portion and fixedly fastened to the inside of said holder base and an opposite end thereof extending out of the front side of said holder base and terminating in a second blade, said third metal conducting member having an end thereof terminating in a second conducting portion and fixedly fastened to the inside of said holder base and an opposite end thereof extending out of the rear side of said holder base and terminating in a second wire connector; and a fuse electrically connected between said second metal conducting member and said third metal conducting member; and a power cable electrically connected to said first metal conducting member and said third metal conducting member.

2. The electrical plug as claimed in claim 1, wherein said sliding cover comprises a cover body coupled to said sliding grooves and kept in close contact, and a handle perpendicularly upwardly extended from one end of said cover body and suspending in said opening.

3. The electrical plug as claimed in claim 1, wherein said top cover and said holder base are fixedly fastened together by ultrasonic fusion.

4. The electrical plug as claimed in claim 1, wherein said second metal conducting member further comprises two first retaining flanges respectively upwardly extended from two opposite lateral sides of said first conducting portion; said third metal conducting member further comprises two second retaining flanges respectively upwardly extended from two opposite lateral sides of said second conducting portion; said fuse is electrically connected between said two first retaining flanges of said second metal conducting member and said two second retaining flanges of said third metal conducting member.

5. The electrical plug as claimed in claim 1, wherein said first wire connector comprises two first mounting flanges respectively upwardly extended from two opposite lateral sides thereof; said second wire connector comprises two second mounting flanges respectively upwardly extended from two opposite lateral sides thereof; said power cable has positive and negative poles thereof respectively electrically connected to said first mounting flanges of said first wire connector and said second mounting flanges of said second wire connector.

6. The electrical plug as claimed in claim 1, further comprising an electrically insulative housing molded on said internal contact holder and said metal conducting member set for allowing said opening, said first blade, said second blade and said sliding grooves to be exposed to the outside.

7. The electrical plug as claimed in claim 6, wherein said holder base of said internal contact holder comprises an extension mount extended from one side thereof remote from said top cover; said metal conducting member set further comprises a fourth metal conducting member fixedly mounted in said extension mount of said holder base and extended out of said electrically insulative housing in the same direction relative to said first metal conducting member and said second metal conducting member and electrically connected with a ground wire of said power cable for grounding.

* * * * *